US007368690B2

(12) United States Patent
Bruwer et al.

(10) Patent No.: US 7,368,690 B2
(45) Date of Patent: May 6, 2008

(54) METHOD OF AND APPARATUS FOR PROCESSING OF SEMI-SOLID METAL ALLOYS

(75) Inventors: Retief Bruwer, Pretoria (ZA); Jeremias Daniel Wilkins, Pretoria (ZA); Lillian Hristov Ivanchev, Germiston (ZA); Pierre Rossouw, Pretoria (ZA); Oliver Frank Rudolf August Damm, Pretoria (ZA)

(73) Assignee: CSIR, Pretoria (ZA)

( * ) Notice: Subject to any disclaimer, the term of this patent is extended or adjusted under 35 U.S.C. 154(b) by 0 days.

(21) Appl. No.: 11/748,402

(22) Filed: May 14, 2007

(65) Prior Publication Data

US 2007/0221665 A1 Sep. 27, 2007

Related U.S. Application Data

(62) Division of application No. 10/545,217, filed as application No. PCT/IB2004/000245 on Feb. 3, 2004, now Pat. No. 7,225,858.

(30) Foreign Application Priority Data

Feb. 10, 2003 (ZA) ..... 2003/1107

(51) Int. Cl.
*H05B 6/04* (2006.01)
*F27D 3/00* (2006.01)
*B22D 27/02* (2006.01)

(52) U.S. Cl. ..... 219/660; 373/142; 164/499

(58) Field of Classification Search ..... 219/660, 219/658, 672, 676, 677; 373/142, 146, 153, 373/154, 157; 164/499, 113, 900, 147.1, 164/476, 335, 452, 468, 338.1, 175, 418, 164/459

See application file for complete search history.

(56) References Cited

U.S. PATENT DOCUMENTS

| | | | | |
|---|---|---|---|---|
| 4,197,900 | A | 4/1980 | Bloshenko et al. | |
| 4,465,118 | A * | 8/1984 | Dantzig et al. | 164/452 |
| 5,178,204 | A | 1/1993 | Kelly et al. | |
| 6,443,216 | B1 | 9/2002 | Lombard et al. | |
| 6,796,362 | B2 | 9/2004 | Lombard et al. | |

FOREIGN PATENT DOCUMENTS

| | | |
|---|---|---|
| EP | 0 931 607 | 7/1999 |
| EP | 1 050 353 | 11/2000 |
| GB | 2 042 385 | 9/1980 |
| JP | 09152278 A * | 6/1997 |

* cited by examiner

*Primary Examiner*—Quang Van
(74) *Attorney, Agent, or Firm*—Klarquist Sparkman, LLP

(57) ABSTRACT

Apparatus for producing a semi-solid metal alloy from a molten charge includes vertically aligned treatment zones which are provided by vertically aligned passages defined by a plurality of spirally wound flow pipes which are interspersed between spirally wound induction coils. A container is mounted on a charging arrangement which displaces a first charge upwardly into the first treatment zone. Successive charges are introduced in a similar fashion thereby urging the previously introduced charge upwardly along the train of zones and until the leading charge is ejected from the top of the apparatus. The charge in each zone is subjected to controlled cooling and an induced electromagnetic field. The strength of the field and the rate of cooling are controlled to impede dendritic crystallisation and to promote globular primary crystal formation.

10 Claims, 9 Drawing Sheets

| | | |
|---|---|---|
| Magnification | : | 90x |
| Average grain size | : | 67 μm |
| Shape factor | : | 1.37 |

METHOD OF AND APPARATUS FOR PROCESSING OF SEMI-SOLID METAL ALLOYS

CROSS REFERENCE TO RELATED APPLICATION

This is a division of application Ser. No. 10/545,217, filed Jan. 9, 2006, now U.S. Pat No. 7,225,858 which was the National Stage of International Application No. PCT/IB2004/00245, filed Feb. 3, 2004, all of which applications are incorporated herein by reference.

THIS INVENTION relates to the processing of metal alloys in a semi-solid state known as Semi-Solid Metals technology (SSM). In particular, the invention relates to a method and apparatus for producing a semi-solid metal alloy.

A known SSM processing route is that of thixo-casting. The thixo-casting processing route involves manufacturing billets having a desired microstructure (which is usually supplied to a forming facility by a producer or continuous caster) followed by re-heating to a semi-solid state and forming into the desired product. One of the known advantages of the thixo-casting process is that the forming facility is able to process the semi-liquid metal which readily lends itself to automation of the process. Some of the disadvantages of the thixo-casting process include the difficulty in obtaining fully homogenous billets in a continuous casting (electromagnetic stirred); metal losses during re-heating of the billet; and undesired oxidisation during the re-heating process on the surface of the billet. In addition, gates and risers arising from the formed product cannot usually be re-cycled by the forming facility and must be sent back to the producer/continuous caster, which leads to additional costs.

Thixo-casting, in which the billets are moulded after they are heated to temperatures that produce semi-solid state metals, is different from another known processing route, namely, the rheo-casting processing route. In the rheo-casting processing route, molten metal alloy containing globular or spherical primary crystals is produced continuously and moulded as such without being solidified into billets. In this process the liquid alloy is cooled down to a temperature between the alloys liquids and solids temperature i.e. to provide an alloy in a semi-solid state. This is done in a controlled manner with agitation and, optionally, with the addition of grain refining agents. The slurry is, subsequently, formed into the desired product. The object of the controlled cooling process and agitation is to avoid or impede dendritic crystallization and, instead, to promote the formation of globular or spherical primary crystals suspended in a liquid eutectic. The desired microstructure is obtained by the combination of controlled cooling, stirring and, optionally, the addition of a grain refining agent.

One of the advantages of the rheo-casting processing route is that the forming facility is able to re-cycle the scrap in-house and there are insignificant metal losses since there is no re-heating. One of the disadvantages with this processing route is that, being a controlled process which produces the desired microstructure in a single stage, the apparatus and processes of which the Applicant is aware require complex design and manufacturing facilities to ensure effective operative association with the final product forming stage.

It is an object of this invention to provide a method and apparatus which find substantial utility in the rheo-casting processing route and which provide a less cumbersome and more streamlined or simplified processing route compared to apparatus and methods of which the Applicant is aware.

According to one aspect of the invention, there is provided a method of producing a semi-solid metal alloy for use in forming a final product, which method includes providing a treatment zone which is defined by an AC induction coil and charge cooling means;

introducing a charge of contained molten metal into the treatment zone by displacing said charge along a linear path from a starting position which is aligned with the treatment zone;

simultaneously subjecting the charge to an electromagnetically induced force field and controlled cooling in said treatment zone, said force field being induced by supplying said induction coil with current in the range of 100 to 12000 amps and at a frequency of between 60 to 30000 Hz thereby to provide a force field intensity which is sufficient to induce turbulence and vibratory motion in the charge during cooling to promote primary globular crystal formation instead of dendritic crystal formation; and displacing said treated charge from the treatment zone by urging a subsequent charge into the treatment zone along said linear path.

It is to be understood that, for a particular alloy, the intensity of the electromagnetic field and the rate of cooling are selected to impede dendritic crystallization and to promote the formation of globular or spherical primary crystals thereby to provide a semi-solid metal alloy of desired microstructure for subsequent shaping or forming. The electromagnetic field, in addition to inducing turbulence within the charge, induces a vibratory field in the charge which assists in impeding the formation of dendritic cystals.

The charge may be displaced from the treatment zone into at least one further treatment zone which is arranged in series and aligned with said treatment zone.

Preferably, the method includes continuously introducing a subsequent charge into the first of said treatment zones along the linear path thereby urging the previously introduced charge which occupies the treatment zone through the at least one further treatment zone. This is done in a step-wise or sequential fashion until the leading charge is ejected from the last of said treatment zones.

Thus, a plurality of treatment zones may be arranged in series and aligned with the linear path thereby providing a train of treatment zones. In this embodiment, continuously introducing a fresh charge into the first treatment zone advances previously introduced charges in a step-wise fashion along the train.

The train of treatment zones may be vertically aligned with the charges being advanced upwardly along the train by the introduction of the fresh charge into the train. Thus, the charges may be stacked in end-to-end fashion in the treatment zones.

In other words, the method may include urging the charges into the first of said treatment zones in a vertical direction along the linear path to provide a stack of vertically aligned charges.

The method may include supporting the charge in the first treatment zone and releasing said support when a fresh charge is introduced thereby to allow said charge to be urged from the treatment zone.

In particular, the charges may be introduced upwardly into the first treatment zone, and the method may further including supporting the charge which occupies the first treatment zone in a fixed position and releasing said support simultaneously with the introduction of a fresh charge into the first treatment zone. This allows said fresh charge initially to support the charge in the first treatment zone (for example, by resting on its upper end) and subsequently to displace the charge from the treatment zone on being advanced.

The method may include sensing the temperature of the charge in the first and/or further treatment zones.

The electromagnetic field may be induced by an AC induction coil.

The cooling in any one of the treatment zones may be provided by a gaseous coolant being discharged in at least one cooling flow stream onto or towards the charge.

According to another aspect of the invention, there is provided an apparatus for producing a semi-solid metal alloy from a molten charge of said alloy, the apparatus including

- a treatment zone into which a charging container is receivable;
- charge cooling moans for cooling the charge when the container is positioned in the treatment zone;
- electromagnetic force field inducing means for inducing an electromagnetic force field in the charge when positioned in the treatment zone, said electromagnetic field inducing means being in the form of an AC induction coil to which a current of 100 to 12000 amps is supplied at a frequency of 60 to 30000 Hz, in use, thereby to induce a force field of sufficient intensity to promote primary globular crystal formation instead of dendritic crystal formation during cooling; and
- a charging arrangement having supporting means for supporting the charging container in a starting position which is in alignment with the treatment zone and displacement means for displacing the charging container from the starting position along a linear path into the treatment zone, said treatment zone being configured to allow the charging container to be displaced from the treatment zone after treatment by the urging of a subsequent charging container into the treatment zone along said linear path.

The charge cooling means and electromagnetic field inducing means may be arranged to provide a longitudinally extending open-ended passage which defines the treatment zone and into which the charging containers are received. Preferably, the passage may extend vertically.

The apparatus may include a supporting arrangement for supporting the charging container in the treatment zone, said supporting arrangement being configured to, simultaneously with the introduction of a subsequent charging container, release said charging container to allow the charging container to be supported by the subsequent charging container and to permit displacement of said charging container from the treatment zone on advancement of the subsequent charging container into the treatment zone.

The supporting arrangement may include a retaining element which is mounted for displacement between a retracted position, in which the element is clear of the treatment zone, and an extended position, in which it extends into the treatment zone and supports the charging container positioned in the treatment zone.

The retaining element may be provided with an engagement formation which engages with a complementary engagement formation when the retaining element is in the extended position.

The apparatus may include at least one further treatment zone having electromagnetic field inducing means and charge cooling means which are arranged to provide a further longitudinally extending passage which is adjacent to and aligned with the passage of the treatment zone.

Thus, the treatment zones may provide a train of a plurality of treatment zones. Preferably, the apparatus may include two further treatment zones, in addition to the first treatment zone. The treatment zones in the train may be vertically aligned.

The support means may include a charge support on which the charging container is supported, in use, and releasable gripping means for releasably gripping the support. In this embodiment the complementary engagement formation may be provided by the charge support.

The apparatus may include temperature sensing means for sensing the temperature of the charge in the treatment zone(s).

The charge cooling means may include a plurality of independently operable tube sections which follow a helical path and which are positioned between adjacent turns of the induction coil.

The tube sections may be secured to the adjacent turns of the induction coil, for example, by brazing.

The invention will now be described, by way of the following non-limiting example, and with reference to the accompanying diagrammatic drawings.

Figure 1:
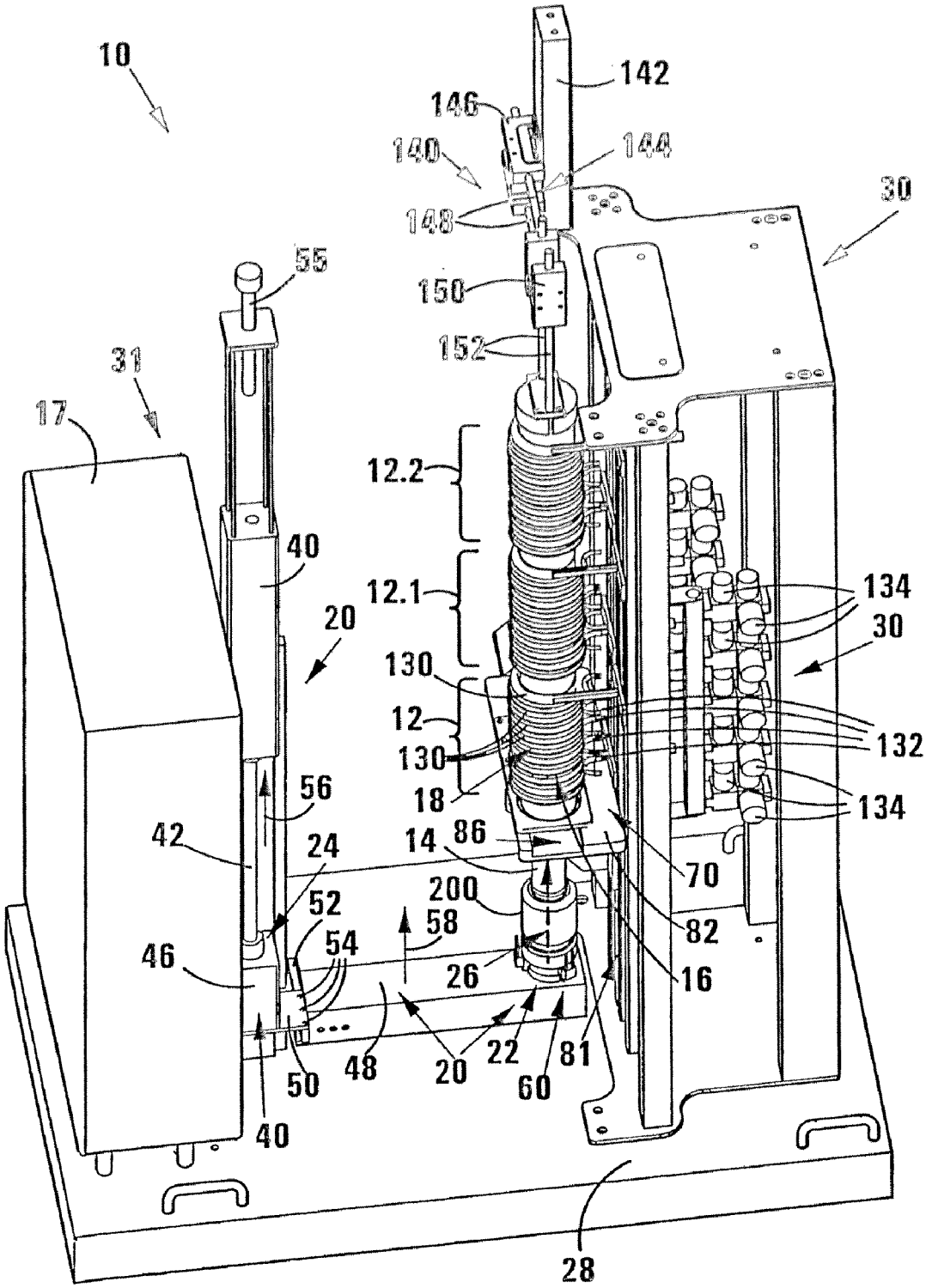
FIG. 1 shows a three-dimensional schematic view of an apparatus in accordance with the invention.

Referring to FIG. 1 of the drawings, reference numeral 10 generally represents an apparatus, in accordance with the invention, for producing a semi-solid metal alloy from a molten charge of the alloy.

The apparatus 10 includes a treatment zone, generally indicated by reference numeral 12 into which a charging container 14 is receivable. The apparatus 10 further includes charge cooling means, generally indicated by reference numeral 16, for cooling a charge when the charging container 14 is positioned in the treatment zone 12, as is described in more detail below. The apparatus 10 also includes electromagnetic field inducing means, generally indicated by reference numeral 18, for inducing an electromagnetic field in the charge when the charging container 14 is positioned in the treatment zone 12, as is described in more detail below.

The apparatus 10 includes a charging arrangement, generally indicated by reference numeral 20. The charging arrangement 20 has supporting means 22 for supporting the charging container 14 in a starting position (shown in FIG. 1 of the drawings) which is in alignment with the treatment zone 12 and displacement means, generally indicated by reference numeral 24, for displacing the container 14 from the starting position along a linear path, indicated by the dotted line labelled with reference numeral 26, into the treatment zone 12, as is described in more detail below.

The treatment zone 12 is configured to allow the charging container 14 to be displaced from the first treatment zone 12 by urging of a subsequent charging container 14 along the linear path 26 into the treatment zone 12, as is also described in more detail below.

The apparatus 10 includes a base member 28 onto which an upwardly extending frame or support assembly 30 is mounted. The charging arrangement 20 is mounted on the base 28 adjacent to the support assembly 30.

Figure 4:
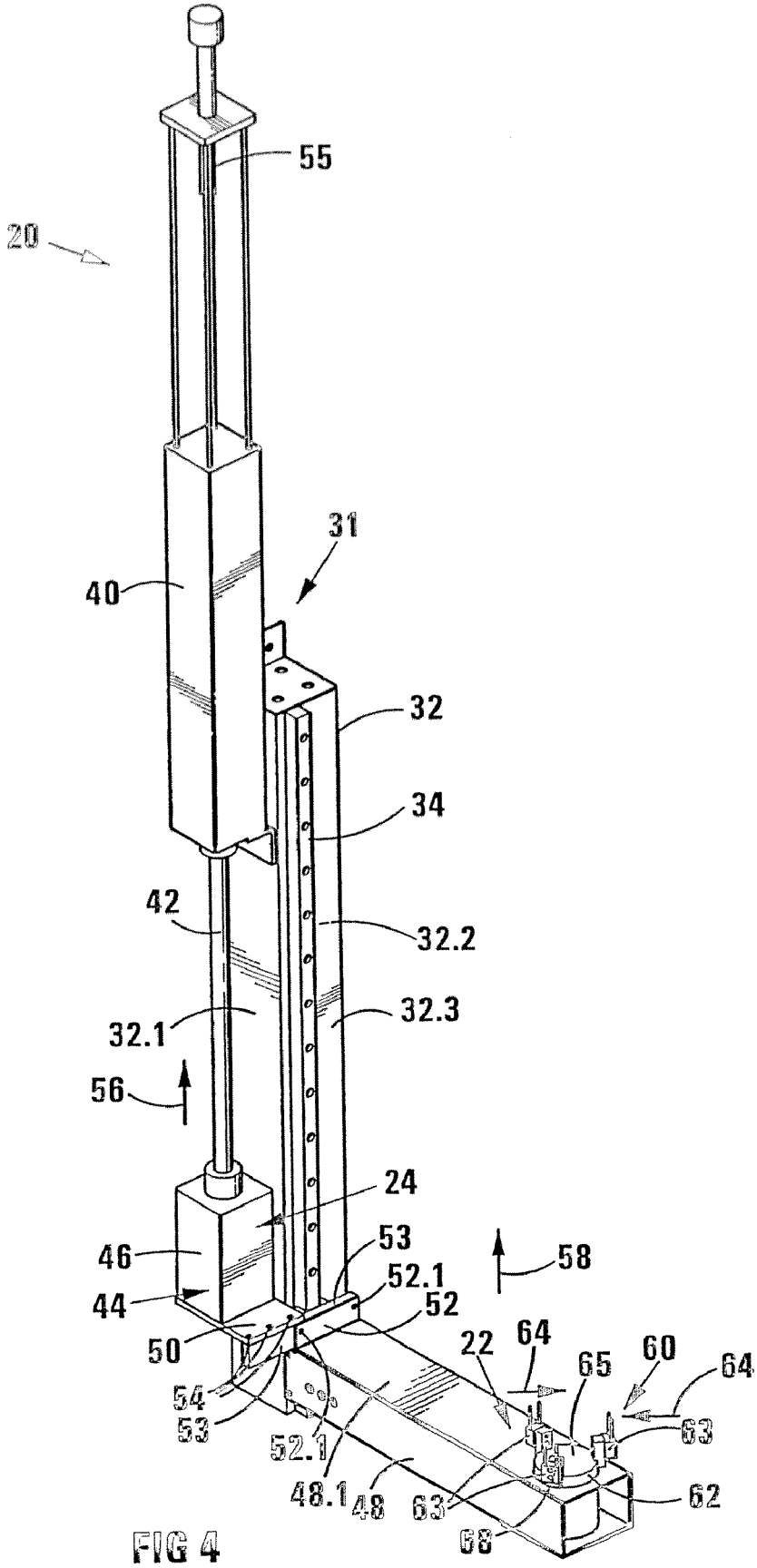
FIG. 4 shows a three-dimensional schematic detailed view of part of a charging arrangement which forms part of the apparatus shown in FIG. 1.

Referring also to FIG. 4 of the drawings, the charging arrangement 20 includes a linear drive unit, generally indicated by reference numeral 31. Only part of tie drive unit 31 is shown in FIG. 4 of the drawings. The drive unit 31 includes a vertically extending rail assembly 32 which is provided with two vertically extending side faces 32.1, 32.2 and a front face 32.3. A vertically extending rail element 34 is mounted on the front face 32.3 and extends parallel to the side faces 32.1 and 32.2.

The drive unit 31 further includes a pneumatically operated main cylinder 40 which extends from and is mounted to an upper free end of the side member 32.1. A piston rod 42 extends from the cylinder 40 in a vertical direction, parallel to the rail element 34. A carriage assembly, indicated generally by reference numeral 44, is mounted to a lower end of the piston rod 42. The carriage assembly 44 includes a second pneumatically operated cylinder 46. A horizontally extending mounting plate 50 protrudes from a side of the cylinder 46.

The supporting means 22 includes an arm 48 which extends parallel to the base 28. An upper surface 48.1 of the arm 48, remote from its free end, is upwardly turned to provide a vertically extending support or mounting element 52. An engagement formation 53 is mounted on the element 52 by means of securing elements 54 and 52.1 thereby connecting the cylinder 46 to the arm 48. As will be appreciated, the engagement formation 53 defines a channel (not shown) which receives the rail element 34 and is slidably displaceable relative thereto.

The linear drive unit 31 is in an extended position in FIGS. 1 and 4 of the drawings. Actuation of the cylinder 46 displaces the piston rod 42 along a short stroke in a direction, generally indicated by reference numeral 56 in FIG. 4 of the drawings, and actuation of the cylinder 40 causes displacement of the rod 42 and cylinder 46 along a long stroke in the same direction. This displacement causes the carriage assembly 44 to be displaced upwardly which in turn displaces the arm 48 along the rail element 34 thereby moving the arm 48 in a direction indicated by reference numeral 58. Similarly, extension of the piston 42 in a downward direction causes the arm 48 to move in a direction opposite to that indicated by reference numeral 58. An adjustable stop 55 is provided which is used to set the extent to which the rod 42 protrudes from an upper end of the cylinder and, hence, controls the stroke length.

The short stroke cycle is used to advance the container 14 along the linear path 26 into a position in which a leading end of the container 14 is positioned in an entrance to the treatment zone 12, as is described below. The long stroke cycle is used to advance the container 14 from this position along the successive treatment zones 12, 12.1 and 12.2, as is described below.

A free end of the supporting means 22 is provided with a circular cylindrical base element 62 which defines an upper circular supporting surface 65 for supporting a charge support 200, which is described in more detail below, with reference to FIGS. 1, 5 and 6 of the drawings.

The free end of the arm 48 further includes releasable gripping means, generally indicated by reference numeral 60 for releasably gripping the support 200 when supported on the base element 62. The gripping means 60 is in the form of three gripping elements 63 which are circumferentially spaced around an upper edge of the base element 62 and which extend upwardly from the surface 65. The elements 63 are mounted for limited radial movement in a direction indicated by the arrow labelled with reference numeral 64 to releasably grip an outer wall of the support 200, as is described in more detail below.

Figure 2:
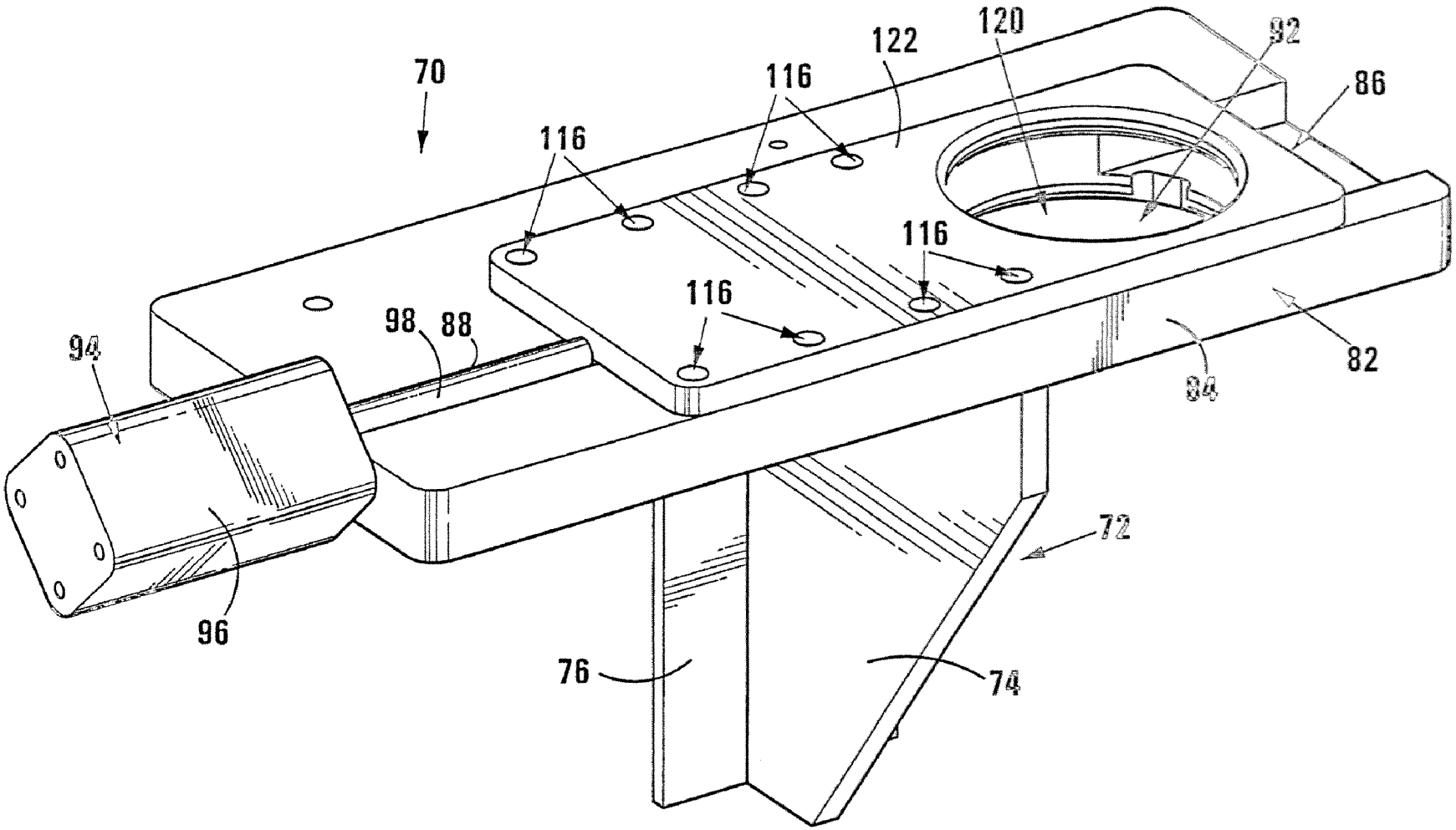
FIG. 2 shows a three-dimensional view of a supporting arrangement which forms part of the apparatus shown in FIG. 1.
Figures 3, 3A:
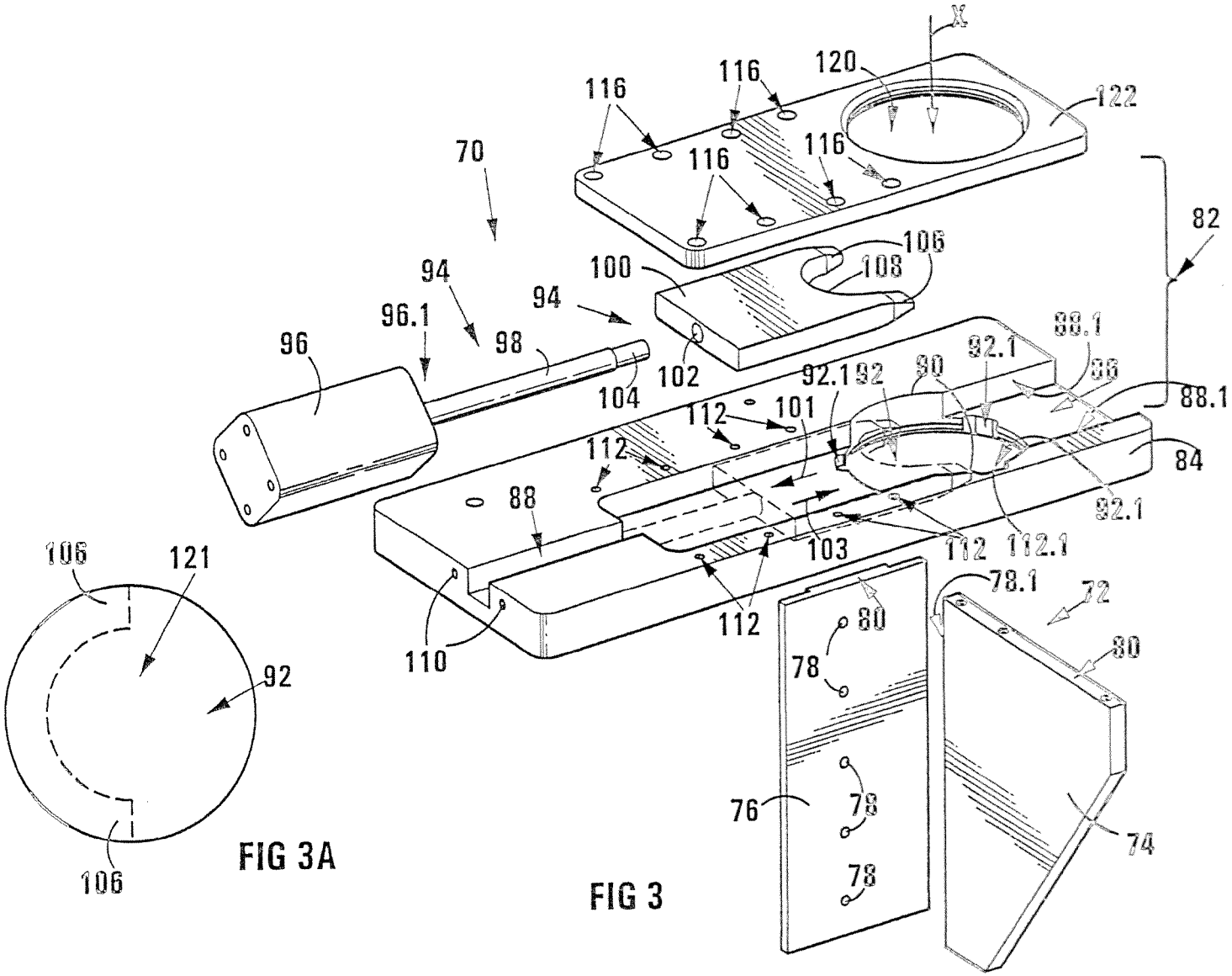
FIG. 3 shows an exploded view of the supporting arrangement shown in FIG. 2.
FIG. 3A shows a schematic operation of part of the apparatus shown in FIG. 1 when viewed from the direction X in FIG. 3.

Referring also to FIGS. 2 and 3 of the drawings, reference numeral 70 generally indicates a supporting arrangement for supporting the charging container 14 in the treatment zone 12, as is described in more detail below. For ease of reference, the supporting arrangement is described in detail with reference to FIGS. 2, 3 and 3A of the drawings. Certain reference numerals have been excluded from FIG. 1 of the drawings, for the sake of clarity.

The supporting arrangement 70 includes a bracket assembly 72 having a generally rectangular bracket element 76 which is provided with a plurality of longitudinally spaced apertures 78 and a Generally triangular-shaped bracket element 74. A leading edge 78.1 of the bracket element 74 is provided with a plurality of longitudinally spaced apertures (not shown) which are in register with the apertures 78 when the bracket assembly 72 is assembled. The bracket assembly 72 includes an upper supporting surface 80 which supports a tray assembly, generally indicated by reference numeral 82, as is described in more detail below. As can be seen schematically in FIG. 1 of the drawings, the bracket assembly 72 is positioned against an inner side 81 of the support assembly 30, for example, by means of securing elements which extend through the apertures 78 and into the corresponding apertures (not shown) provided on the leading face 78.1 thereby to position the supporting arrangement 70, as is shown in FIG. 1 of the drawings.

The tray assembly 82 includes a lower tray element 84 which is generally rectangular in shape. The tray element 84 defines a longitudinally extending recess 86 which opens out of a side of the element 84. A slot 88 extends from an opposed side of the element 84 along the remaining part of the length of the element 84 and opens into the recess 86, as can best be seen in FIG. 3 of the drawings. A pair of apertures 110 is provided adjacent the opening of the slot 88. A generally circular aperture 92 extends through the recessed part of the element 84. Circumferentially spaced slots 92.1 are provided. Opposed inner side walls 88.1 of the element 84 are generally arcuate in shape in the region of the aperture 92, as is indicated by reference numeral 90, so that the aperture 92 is generally circular when seen in plan. A series of longitudinally spaced apertures 112 are positioned adjacent the side walls 88.1.

The arrangement 70 further includes a releasable supporting mechanism generally indicated by reference numeral 94. The supporting mechanism 94 includes a pneumatically operated cylinder 96 and a piston rod 98 which extends horizontally from the cylinder 96. A free end of the piston rod 98 is of reduced or threaded cross-sectional area, as indicated by reference numeral 104. The releasable supporting mechanism 94 further includes a retaining element in the form of a tongue 100. The tongue 100 is in the form of a plate having an aperture 102 extending out of a side thereof into which the end 104 of the piston rod 98 is received. An opposed end of the tongue 100 includes a pair of laterally spaced fork members 106. An arcuately shaped end wall 108 extends between the fork members 106.

The tray assembly 82 further includes a cover plate 122 which is generally rectangular in shape and includes two laterally spaced rows of apertures 116 which extend through opposed major sides of the cover plate 122. An end face 96.1 of the cylinder 96 is provided with a pair of laterally spaced supporting pins (not shown). The mechanism 94 is mounted such that the supporting pins extend into the apertures 110 and such that the piston rod 98 extends along the slot 88 and protrudes into the recess 86. In this position, the tongue 100 is slidably received in the recess 86. The cover plate 122 is positioned over the element 84 such that the apertures 116 are in register with the apertures 112 and is secured to the element 84 by means of securing elements (not shown) passing through the apertures 116, 112 thereby to retain the mechanism 94 in position. The cover plate 122 includes a circular aperture 120 which, as can best be seen in FIG. 2 of the drawings, when the cover plate 122 is mounted in position, is in register with the aperture 92 to provide a circular cylindrical passage 121 (see FIG. 3A) which extends through the tray assembly 82.

When the cylinder 96 is actuated to withdraw the piston rod 98 the tongue element 100 is withdrawn into the recess 86 in a direction generally indicated by the arrow labelled with reference numeral 101 such that the fork members 106 are clear of the passage defined by the apertures 120, 92 to allow free movement therethrough. When the cylinder 96 is actuated to extend the piston rod 98 in a direction shown by reference numeral 103 the tongue 100 is slidably displaced within the recess 86 such that the fork members 106 extend into the passage for supporting the support 200, as is described in move detail below. As can be seen in FIG. 3A of the drawings, the fork members 106 and part of the tongue 100 adjacent the side wall 108 extend into the passage 121 when in the extended position.

Referring now to FIG. 1 of the drawings, the electromagnetic inducing means 18 is in the form of a spirally wound induction coil 130 which extends along a length of the treatment zone 12 and is supported by the support assembly 30. The cooling means 16 is in the form of a plurality of spirally wound flow pipes 132 which are positioned between adjacent coil elements of the induction coil 130. The pipes 132 are independently operable along the length of the treatment zones. Thus, different air flow rates may be provided at different positions along a length of the treatment zone 12 thereby to control the temperature gradient. The induction coil 130 and the pipes 132 extend along the length of the first treatment zone 12 to provide a jacket which defines a generally circular cylindrical passage which is in register with the passage 121 provided by the apertures 92 and 120 in the tray 82.

Two further treatment zones 12.1 and 12.2 are supported by the support assembly 30 above the treatment zone 12. The treatment zones 12.1 and 12.2 are arranged in series and are vertically aligned with the treatment zone 12 such that their passages are in register with the passages of the treatment zone 12. Each of the treatment zones 12.1 and 12.2 is provided with cooling means and electromagnetic field inducing means 18 which is the same as that which is provided in the treatment zone 12 and, therefore, is not described again in detail.

The pipes 132 and the similar pipes of the treatment zones 12.1 and 12.2 are connected to a gaseous supply, for example an air supply, by means of a piping network (not shown). The flow of air to the pipes 132 is controlled by means of nozzles 134.

The coil 130 and coils of the treatment zones 12.1 and 12.2 are connected in series to an induction generator supplying current ranging from approximately 100 to 12000 amps at a frequency from 60 Hz to 30000 Hz. The electromagnetic field induces turbulence and vibratory motion in the charge to facilitate the growth of the primary crystals instead of the dendritic crystals.

Figure 8:
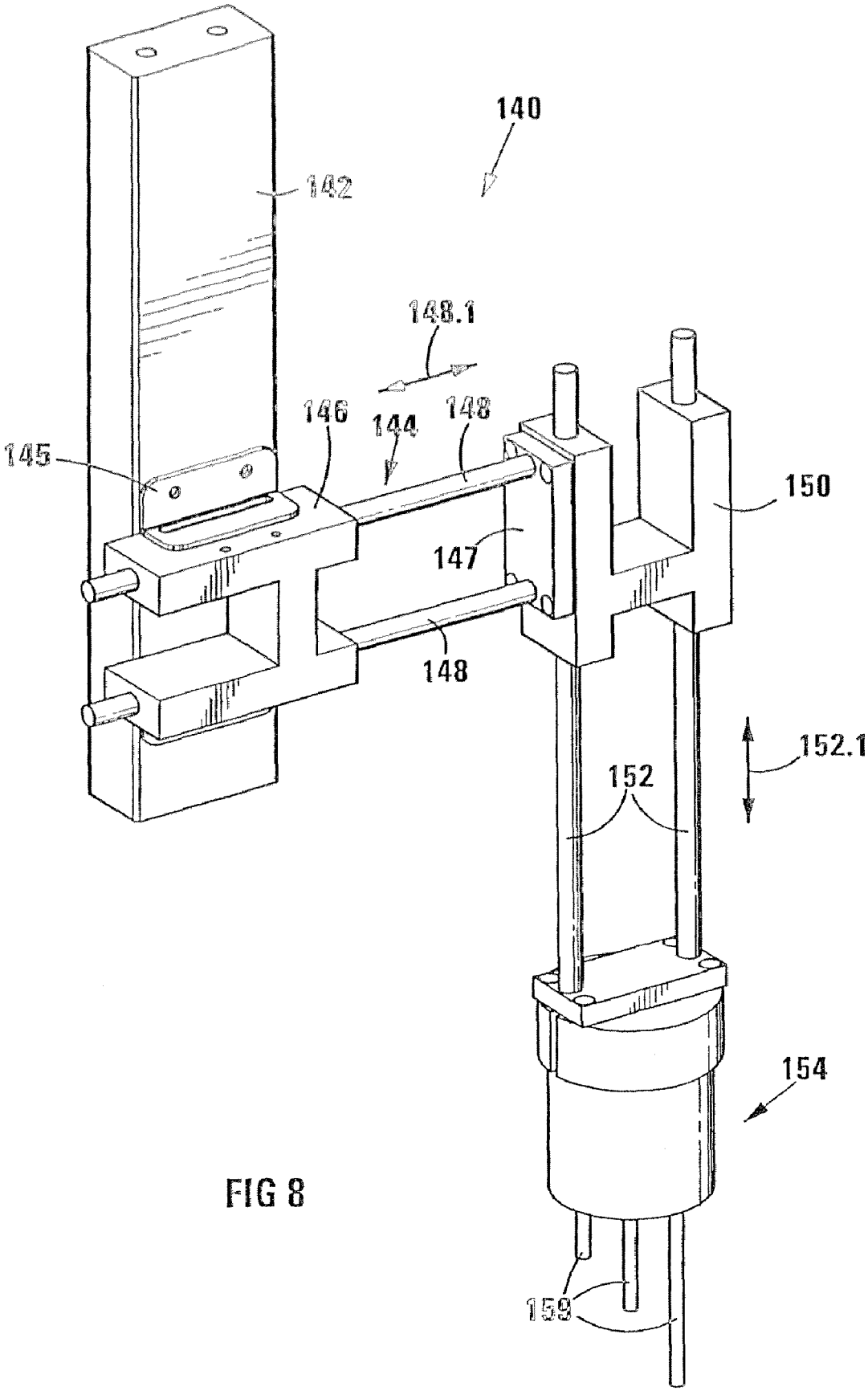
FIG. 8 shows a detailed three-dimensional schematic view of temperature sensing means which forms part of the apparatus shown in FIG. 1.

Referring to FIGS. 1 and 8 of the drawings, temperature sensing means, generally indicated by reference numeral 140, is mounted on the support assembly 30. The temperature sensing means 140 includes a vertically extending support arm 142 which is mounted on the assembly 30. As can best be seen in FIG. 8 of the drawings, a supporting arrangement 144 is connected by a bracket 145 to the arm 142 and extends horizontally from the support arm 142. The arrangement 144 includes a mounting block 146 which carries a pair of elongate support elements 148. The elements 148 are slidably displaceable in a horizontal direction 148.1 within the block 146 on being actuated by a pneumatic cylinder (not shown). The elements 148 are connected by a flange 147 to a further mounting block 150 from which a pair of further supporting elements 152 extend in a vertical direction. The elements 152 are displaceable in a vertical direction 152.1 in a similar fashion to the elements 148. A temperature sensing head 154 is mounted to the free end of the vertically extending conducting elements 152. In use, the sensor head 154 is positioned at an exit from the treatment zone 12.2 and is provided with thermocouples 159 which measure appropriate temperature readings of semi-solid metal in a container 14 as it is removed from the treatment zone 122, as is described in more detail below. The thermocouples 159 are of different length to provide a temperature profile across a length of the container 14.

Figure 5:
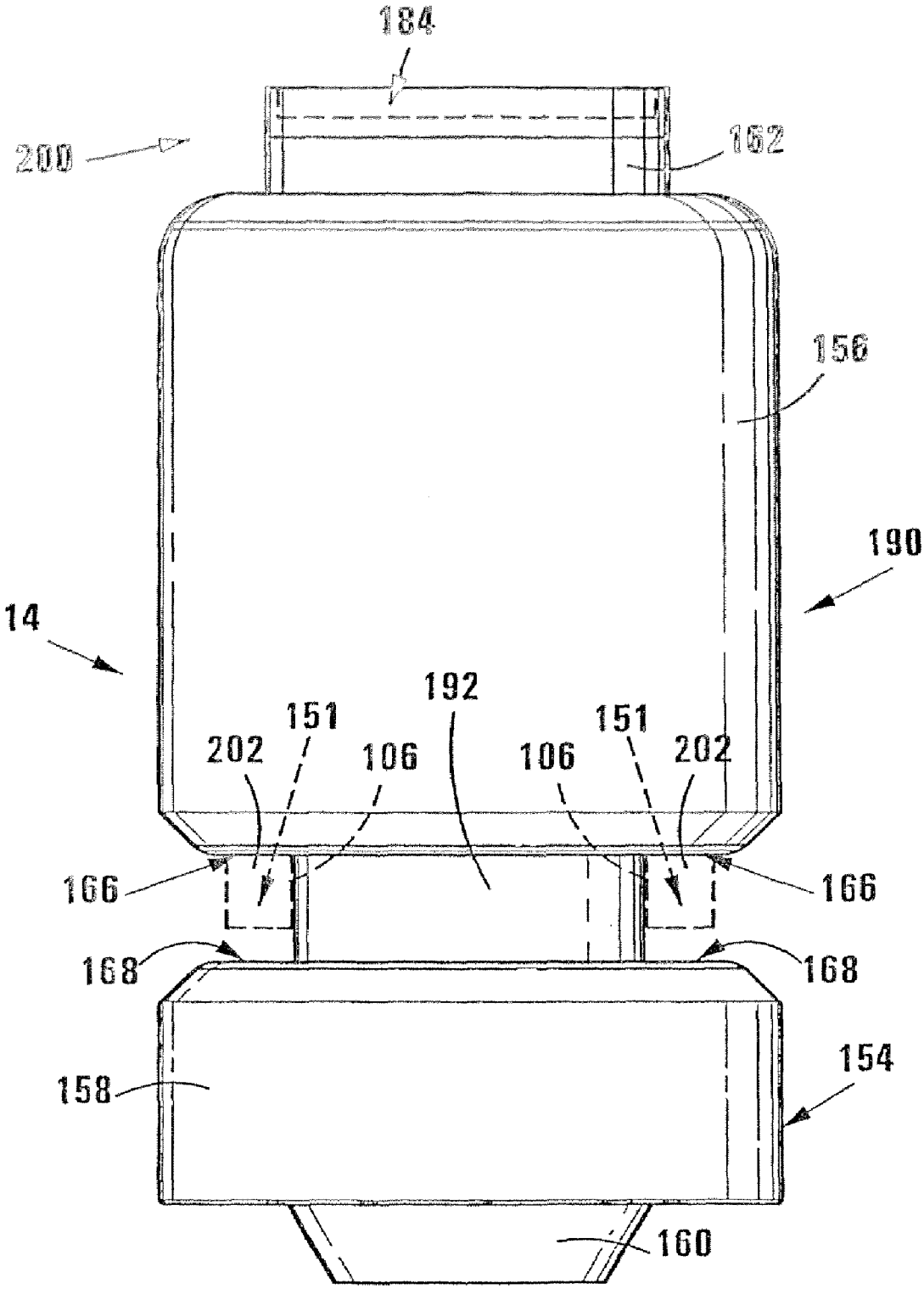
FIG. 5 shows, in detailed side view, another part of the charging arrangement which forms part of the apparatus shown in FIG. 1.
Figure 6:
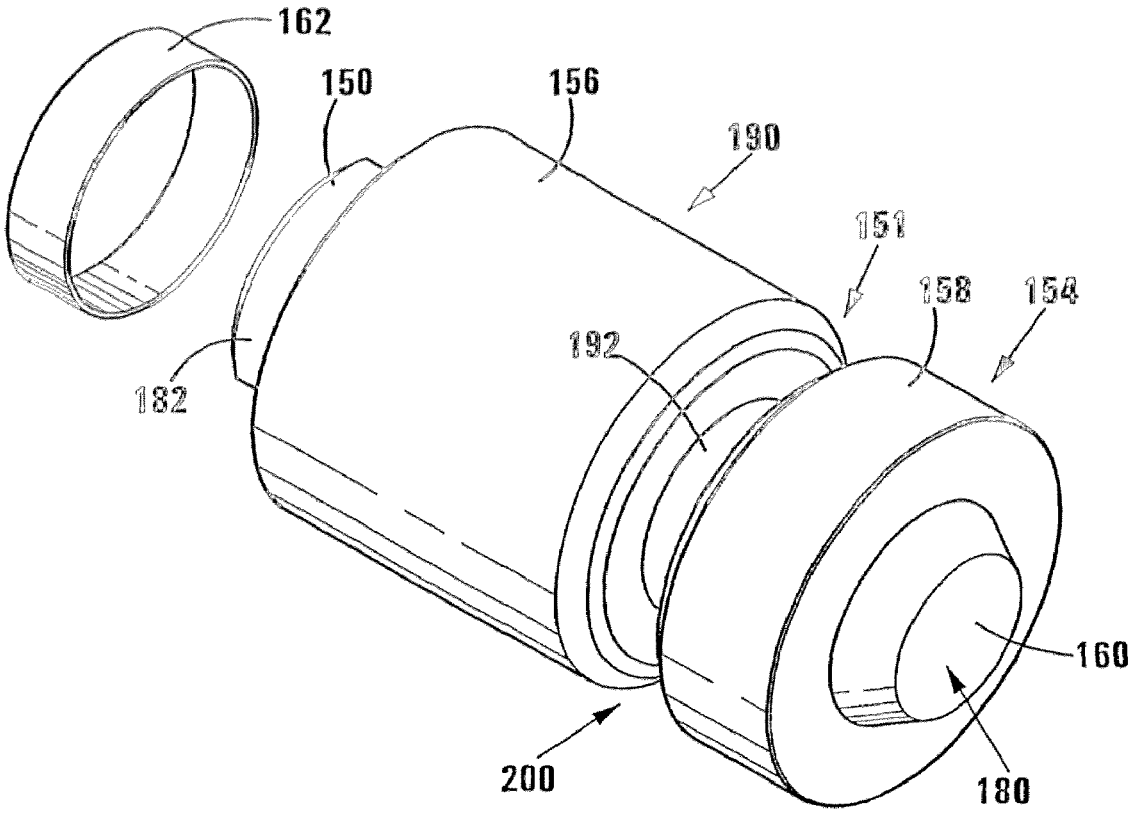
FIG. 6 shows part of the charging arrangement shown in FIG. 5 in three-dimensional view.

Referring to FIGS. 5 and 6 of the drawings, the pedestal or charge support 200 includes a generally circular cylindrical body 190. The body 190 includes a circular cylindrical upper part 156 and a circular cylindrical lower part 158 between which is provided a waist 192 of reduced diameter. As can best be seen in FIG. 5 of the drawings, an annular gap 151 is defined between opposed circumferentially extending faces 166 and 168 of the upper and lower parts 156, 158. The faces 166, 168 and the waist 192 define an engagement formation into which the fork members 106 are received, as is described in more detail below, and as is shown schematically by reference numeral 202 in FIG. 5 of the drawings.

A frusto-conical seat formation 160 extends from the lower part 158 and defines a circular cylindrical seat 180 (see FIG. 6 of the drawings) which seats on the supporting surface 65 of the charging arrangement 20. A head portion 182 (see FIG. 6 of the drawings) protrudes from the upper part 156. A ring 162 is fitted onto the head portion 182. An upper edge of the ring 162 protrudes beyond the head portion 182 and, as can be seen in FIG. 5 of the drawings, defines a seat 184. The support is made of a ceramic material.

Figure 7:
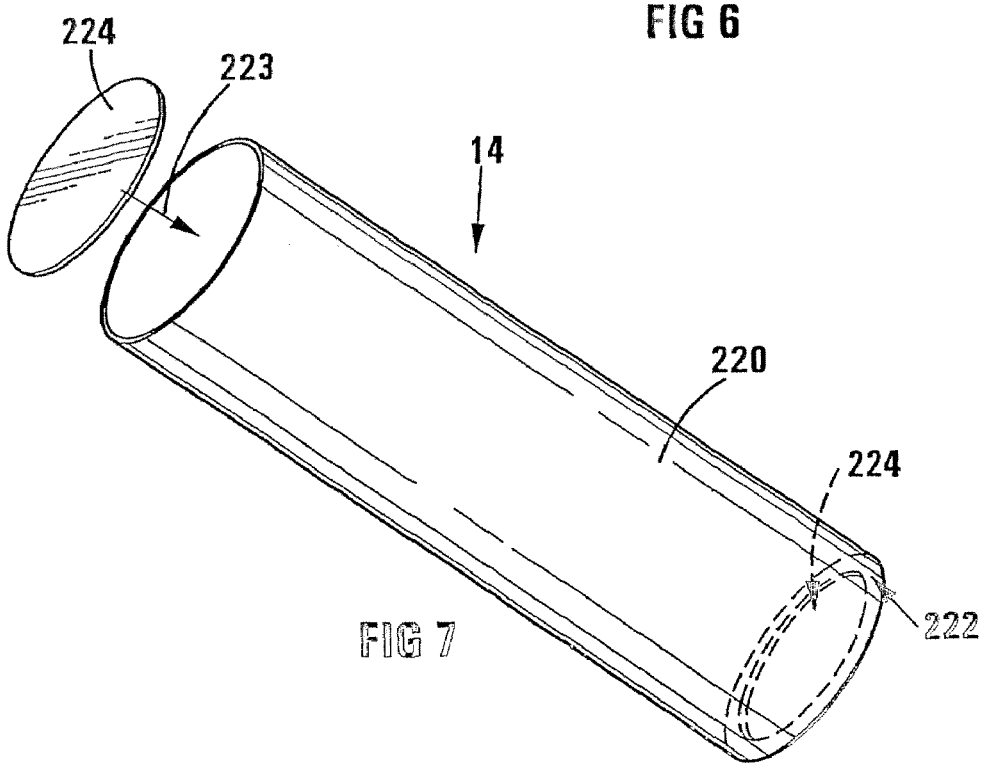
FIG. 7 shows a three-dimensional view of a charging container used with the apparatus.

Referring to FIG. 7 of the drawings, the container 14 includes a barrel 220 of, for example, austenitic stainless steel. Typically, the barrel has a wall thickness of about 1.6 mm to 4.0 mm. A circumferentially extending rim 222 is provided at a lower end of the barrel 220 and a base element 224 is inserted into the barrel, from the top, as is indicated by the arrow 223 such that the base 224 seats against the rim 222. The base element 224 may be pushed out in order to eject a slurry billet from the container 14 in semi-solid state.

The operation of the unit 31, the mechanism 94, the induction coils 130, the nozzles 134 and the temperature sensing means 140 may be linked to an automated computer process control unit mounted in a control box 17 (see FIG. 1) to control the apparatus 10 and method in the manner described below.

Figure 9:
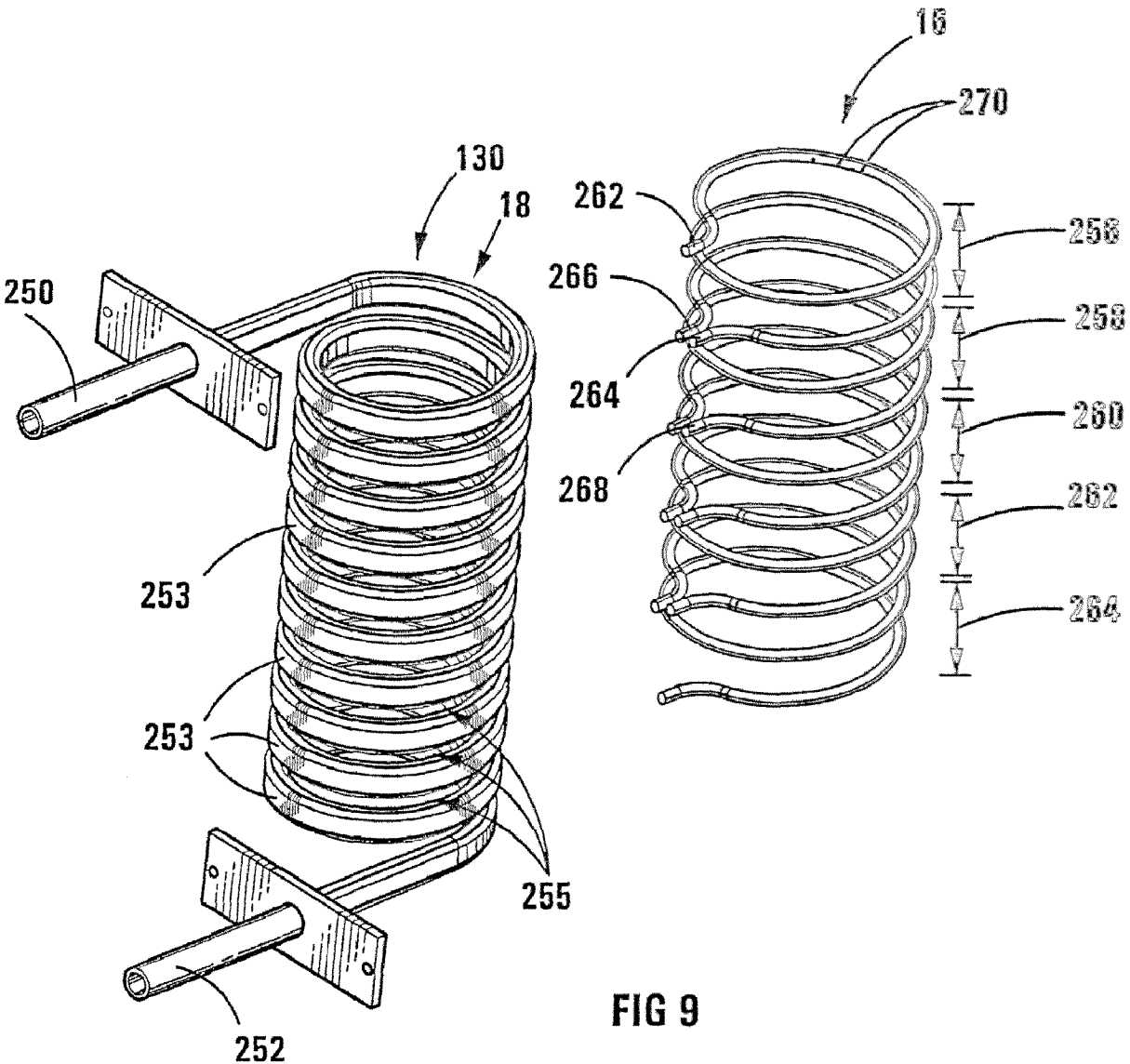
FIG. 9 shows a three dimensional view of electromagnetic field inducing means and charge cooling means which form part of the apparatus shown in FIG. 1.

Referring now to FIG. 9 of the drawings, the induction coil 130 is provided with two end connections 250, 252 which are connected to an AC power supply (not shown). A plurality of helical turns 253 are provided between the end sections 250, 252. The turns 253 are longitudinally spaced to provide a plurality of gaps 255 along the length of the coil 130. The charge cooling means 16 includes a plurality of tube sections 256, 258, 260, 262 and 264 each of which follows a helical path. The upper of the tube sections 256 is provided with an inlet 262 at its upper end through which gaseous coolant passes. The tube section 256 terminates at an outlet 264 from which the gaseous coolant is returned to its supply point. The second of the tube sections 258 is provided with an inlet 266 for gaseous coolant which is adjacent to the outlet 264 and terminates in a lower outlet 268. Similar independent circuits are provided in respect of the remaining tube sections 260, 262 and 264 and are not described in detail. When the apparatus is assembled, the tube sections 256 to 264 are positioned between the adjacent turns 255 of the induction coil 130 along the length of the induction coil to provide a jacket which includes five independently operable cooling circuits (to provide more flexible control of the cooling along the length of the treatment zone) and electromagnetic field inducing means (which provides the turbulence and vibratory motion). Each of the tube sections 256 to 264 are provided with circumferentially spaced inwardly directed apertures 270 (only a few of which are shown in FIG. 9 of the diagrams) to direct the gaseous coolant into the treatment zones 12, 12.1 and 12.2. The tube sections 256 to 264, when positioned in the induction coil 130, are secured to the induction coil 130 by brazing upper and lower portions of the turns of the tube section 256 to 264 to adjacent portions of the induction coil 130.

In use, when in the starting position shown in FIG. 1 of the drawings, the support 200 is positioned on the arm 48 such that the seat 180 rests on the supporting surface 65 and the gripping means 60 is actuated, via the control unit, such that the fingers 63 are displaced inwardly and engage with the lower part 158 of the support 200. The container 14 is positioned on the support 200 such that the lower part thereof is received in the seat 184 defined by the protruding head 182 and the ring 162.

Molten alloy, which is superheated to from about 15° C. to 50° C. above the alloy's melting temperature, is poured into the container 14 which is maintained at ambient temperature. The container 14 is coated with a refractory solution to prevent the container walls from being wetted with molten material and to enable easy discharge of the semi-solid alloy or slurry from the container 14 after the process has been completed.

With the container 14 charged with the molten metal alloy, the drive unit 31 is activated in order to displace the arm 48 along the short stroke (via actuation of the cylinder 46) in the direction indicated by the arrow 58 (as is described above with reference to FIG. 4) so that the container 14 is displaced along the linear path 26 from the starting position to a position in which the leading end of the container 14 is level with the tray assembly 82. Thereafter, the container 14 is advanced into the treatment zone 12 by displacement along the long stroke (via actuation of the cylinder 40). During this process, the cylinder 96 of the supporting arrangement 70 is actuated such that the tongue 100 is in a retracted position to enable the container 14 to pass through the aperture 92 and 120, into a position in which the annular gap 151 is in register with the recess 86 and the fingers 63 are received in the slots 92.1. Once the container 14 is in position, the cylinder 96 is actuated such that the fork members 106 protrude into the annular gap 151, as is described above, and the supporting surfaces 166 of the support 200 rest on the fork members 106 and the arcuate side wall 108 fits snugly around part of the waist 150. The drive unit 31 is then activated by releasing the gripping means 60 and displacing the arm 48 back to the starting position with the container 14 remaining supported by the fork members 106.

The induction coils 130 are activated in order to induce turbulent flow and to provide the vibratory field in the molten charge. Simultaneously therewith, the flow of air through the nozzles 134 is regulated in order to provide desired cooling and to provide a first nucleation cycle in the treatment zone 12. Typically, the charge is cooled uniformly along the length of the container with a variance of about ±3° C.

After the desired time in the first treatment zone 12, a further support 200 and container 14 of molten metal are advanced along the short stroke towards the first treatment zone 12 (as is described above) until a leading upper end of the container 14 abuts the seat 180 of the support 200 positioned in the treatment zone 12. Since the further container 14 now supports the container 14 in the treatment zone 12, the cylinder 96 is actuated in order to retract the tongue 100 so that the fork members 106 are clear of the passage. The further container 14 is then urged by displacement along the long stroke into the first treatment zone 12. This fresh charge abuts the container 14 that was originally in the treatment zone 12 and displaces it in to the next treatment zone 12.1 where it is supported in position by the seat 180 resting on a leading end of the fresh container 14 now positioned in the first treatment zone 12. A subsequent charge is introduced into the treatment zone 12 in the same manner which advances the charge 14 in the treatment zone 12.1 into the treatment zone 12.2 and similarly advances the container 14 in the treatment zone 12 into the treatment zone 12.1. When the next container 14 is being collected the stack of containers in the treatment zones 12, 12.1 and 12.2 are supported by the fork member 106 supporting the lowermost container 14.

After a desired time period in the treatment zone 12.2, a temperature reading is taken by inserting the sensing head 154 into the upper opening of the uppermost container 14. The sensing head 154 is manipulated into and out of position by actuation of the elements 148 and 152. The second and third treatment zones 12.1 and 12.2 include a further stirring and controlled cooling process in order to narrow the nucleation process to obtain the desired semi-solid temperature and microstructure.

The process is continued by feeding a fresh container 14 into the first treatment zone 12.1 and, thereby, advancing each of the containers 14 in the train one position up in order to eject the uppermost container 14 from the apparatus 10. By measuring the temperature just prior to ejection, the sample that is removed from the treatment zone 12.2 may serve to make adjustments to the cooling rate in order to obtain the desired temperature on leaving the treatment zone 12.2.

After a container 14 is ejected from the treatment zone 12.2, either manually or by an automated device, the container 14 is transferred to the shot sleeve of a high pressure die-casting (HPDC) machine for further forming in the semi-solid state.

Table 1 below shows a breakdown of the times and the sequential advancement of various containers or cups through the apparatus 10.

TABLE 1

| | PROCESSING TIME PER UNIT | | | | | |
|---|---|---|---|---|---|---|
| Treatment Zone | 1 minute | 1 minute | 1 minute | 1 minute | 1 minute | 1 minute |
| 12 | Cup 1 | Cup 2 | Cup 3 | Cup 4 | Cup 5 | Cup 6 |
| 12.1 | empty | Cup 1 | Cup 2 | Cup 3 | Cup 4 | Cup 5 |
| 12.2 | empty | empty | Cup 1 | Cup 2 | Cup 3 | Cup 4 |
| Shot sleeve of HPDC machine | empty | empty | empty | Slurry 1 | Slurry 2 | Slurry 3 |

An example using the apparatus 10 and the method of the invention is now described. The apparatus 10 and method find particular application for light alloys such as aluminium, magnesium and zinc alloys.

EXAMPLE 1

An aluminium-silicon alloy A356 is melted in a melting furnace at a temperature from 720° C. to 780° C. and then transferred to a holding furnace. A dosing furnace which provides protective gas on the molten metal surface and is able to pour a desired quantity of liquid alloy in a container was used. The temperature change of the metal alloy during pouring is controlled within a range of ±1° C. to 2° C. of the desired temperature. The pouring temperature was 629° C. to 631° C. The liquid metal at that temperature is poured onto the wall of the container 14, tilted at about 30° to 40° with respect to a vertical axis. The first container 14 with liquid metal alloy is transferred to the supporting surface 65 by hand or by a 6 axis robot, placed onto the support 200, and then transported by the drive unit 31 to the first treatment zone 12.1. At about one minute intervals, second and third containers 14 are introduced into the apparatus so that the first container is positioned in the treatment zone 12.2. The temperature sensing means 140 is then used to measure the final temperature and to adjust the rate of cooling in order to achieve the final temperature profile of the semi-solid slurry, if required. The subsequent containers are ejected by adding additional containers 14. The ejected containers are then ready for robotic or manual casting and are ejected into the shot sleeve of the die-casting machine.

Figure 10:
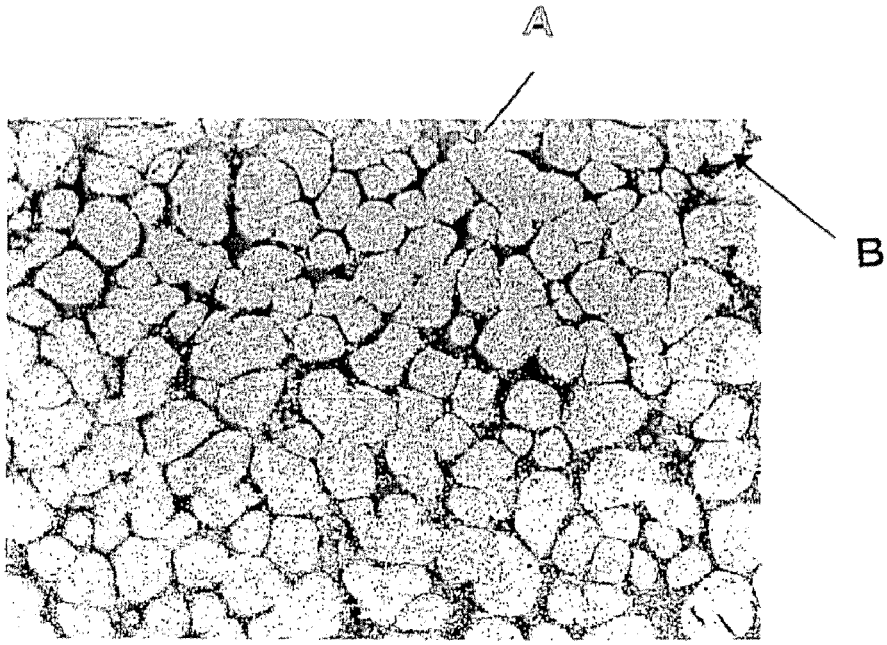
FIG. 10 shows a photograph of the microstructure of the alloy in accordance with the example.

Set out in FIG. 10 is a photograph of the microstructure of the alloy in accordance with the example viewed through a Scanning Optical Microscope. The primary Aluminium crystals (A) are interspersed in a eutectic mixture (B) of AL—Si—Mg with an absence of dentritic crystallization The Applicant believes that it is an advantage of the invention that by aligning the conditioning or treatment zones 12, 12.1 and 12.2 vertically, and by advancing the container 14 along the linear path 26, the problem of using a relatively large floor space which is associated with more complex and cumbersome apparatus of which the Applicant is aware, is alleviated. Thus, it is expected that the capital cost of such apparatus is relatively low. The end-to-end and stepwise or sequential advancement of the containers 14 through the treatment zones 12, 12.1 and 12.2, with simultaneous controlled cooling and stirring in each of the treatment zones, provides a simplified method in a compact apparatus which is able to offer the desired tight process control typical of the rheo-casting process, in order to obtain the desired microstructure and desired semi-solid temperature for treatment in the high pressure die-casting machine, as compared to apparatus and processes of which the Applicant is aware. The circular cylindrical passages with the "jacket" of cooling provide relatively uniform temperature distribution through the charge. The Applicant also believes that the simultaneous cooling and stirring provides a relatively shorter process and improves the structural characteristics of the semi-solid metals as compared to apparatus and methods of which the Applicant is aware. The Applicant also believes that the end-to-end stacking provides a relatively closed environment during processing thereby alleviating the problem of oxidation. The Applicant believes that the apparatus and method lends itself easily to be incorporated into existing SSM thixo-casting HPDC machines which opens opportunities to adopt SSM technology or to switch from the thixo-casting to the rheo-casting process with relatively low investment costs. The apparatus and method is flexible in that the number of treatment zones may be altered to suit the process, alloy requirement and the cycle time with minimum modifications to the apparatus. In addition, the space efficient and elegant design of the apparatus allows sizing of apparatus for the treatment of billets in excess of 7.5 kg. Apparatus of which Applicant is aware are less suitable at this size owing to the economic constraints imposed by the nature of the design.

What is claimed is:

1. An apparatus for producing a semi-solid metal alloy from a molten charge of said alloy, the apparatus including:

a treatment zone into which a charging container is receivable;

charge cooling means for cooling the charge when the container is positioned in the treatment zone;

electromagnetic force field inducing means for inducing an electromagnetic force field in the charge when positioned in the treatment zone, said electromagnetic field inducing means being in the form of an AC induction coil to which a current of 100 to 12000 amps is supplied at a frequency of 60 to 30000 Hz, in use, thereby to induce a force field of sufficient intensity to promote primary globular crystal formation instead of dendritic crystal formation during cooling; and a charging arrangement having supporting means for supporting the charging container in a starting position which is in alignment with the treatment zone and displacement means for displacing the charging container from the starting position along a linear path into the treatment zone, said treatment zone being configured to allow the charging container to be displaced from the treatment zone after treatment by the urging of a subsequent charging container into the treatment zone along said linear path.

2. An apparatus as claimed in claim 1, in which the charge cooling means and electromagnetic field inducing means are arranged to provide a longitudinally extending open-ended passage which defines the treatment zone and into which the charging containers are received.

3. An apparatus as claimed in claim 2, in which the passage extends vertically.

4. An apparatus as claimed in claim 3, which includes a supporting arrangement for supporting the charging container in the treatment zone, said supporting arrangement being configured to, simultaneously with the introduction of a subsequent charging container, release said charging container to allow the charging container to be supported by the subsequent charging container and to permit displacement of said charging container from the treatment zone on advancement of the subsequent charging container into the treatment zone.

5. An apparatus as claimed in claim 4, in which the supporting arrangement includes a retaining element which is mounted for displacement between a retracted position, in which the element is clear of the treatment zone, and an extended position, in which it extends into the treatment zone and supports the charging container positioned in the treatment zone.

6. An apparatus as claimed in claim 5, in which the retaining element is provided with an engagement formation which engages with a complementary engagement formation when the retaining element is in the extended position.

7. An apparatus as claimed in claim 2, which includes at least one further treatment zone having electromagnetic field inducing means and charge cooling means which are arranged to provide a further longitudinally extending passage which is adjacent to and aligned with the passage of the treatment zone.

8. An apparatus as claimed in claim 1, in which the supporting means includes a charge support on which the charging container is supported in use, and releasable gripping means for releasably gripping the support.

9. An apparatus as claimed in claim 1, in which the charge cooling means includes a plurality of independently operable tube sections which follow a helical path and which are positioned between adjacent turns of the induction coil.

10. An apparatus as claimed in claim 9, in which the tube sections are secured to the adjacent turns of the induction coil.

* * * * *